US009231317B2

(12) United States Patent
Leifer et al.

(10) Patent No.: US 9,231,317 B2
(45) Date of Patent: Jan. 5, 2016

(54) LOOPED FASTENING ELEMENT FOR REMOVABLY FIXING A CONDUCTOR TO A CURRENT TRANSFORMER HOUSING

(75) Inventors: Christoph Leifer, Bad Driburg (DE); Carsten Thörner, Melle (DE); Dat-Minh Trinh, Barntrup (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 13/515,063

(22) PCT Filed: Dec. 17, 2010

(86) PCT No.: PCT/EP2010/070088

§ 371 (c)(1), (2), (4) Date: Aug. 17, 2012

(87) PCT Pub. No.: WO2011/073397

PCT Pub. Date: Jun. 23, 2011

(65) Prior Publication Data

US 2012/0326823 A1 Dec. 27, 2012

(30) Foreign Application Priority Data

Dec. 17, 2009 (DE) ..... 10 2009 059 006

(51) Int. Cl.
*H01F 27/02* (2006.01)
*H01F 27/06* (2006.01)
(Continued)

(52) U.S. Cl.
CPC ..... *H01R 4/28* (2013.01)

(58) Field of Classification Search
CPC ..... H01F 27/022; H01F 27/02; H01F 27/027; H01F 38/12; H01F 2038/122; H05K 7/1491; F16L 3/20; F16L 3/24; F16L 3/015; H02G 3/32
USPC ..... 336/92, 66, 67, 192, 196, 197
See application file for complete search history.

(56) References Cited

U.S. PATENT DOCUMENTS 3,460,788 A * 8/1969 Goldman ..... 248/74.3
4,021,604 A * 5/1977 Dola et al. ..... 174/51
(Continued)

FOREIGN PATENT DOCUMENTS

CN 101501793 A 8/2009
DE 197 33 852 2/1999
(Continued)

OTHER PUBLICATIONS

International Bureau, English Translation of International Search Report for International Application No. PCT/EP/2010/070088, Jun. 23, 2011, pp. 1-2, Geneva, Switzerland.
(Continued)

*Primary Examiner* — Elvin G Enad
*Assistant Examiner* — Kazi Hossain
(74) *Attorney, Agent, or Firm* — Ohlandt, Greeley, Ruggiero & Perle, LLP

(57) ABSTRACT

The invention relates to a device for removably fixing a conductor (10) to a current transformer housing (12), comprising a fixing element (18) which runs through a retaining element (16) lying on the current transformer housing (12) and which sits at least partly against the surface of the conductor (10) when the conductor (10) is fixed on the current transformer housing (12). The invention is characterized in that the fixing element (18) runs around the circumferential surface of the conductor (10) in a looped manner when fixed.

3 Claims, 2 Drawing Sheets

(51) Int. Cl.

| | |
|---|---|
| ***H01F 27/29*** | (2006.01) |
| ***H01F 27/30*** | (2006.01) |
| ***H01R 4/28*** | (2006.01) |

(56) References Cited

U.S. PATENT DOCUMENTS

| | | | | |
|---|---|---|---|---|
| 4,665,588 | A * | 5/1987 | Nakano | 24/16 PB |
| 4,768,741 | A | 9/1988 | Logsdon | |
| 4,910,831 | A * | 3/1990 | Bingold | 24/16 PB |
| 5,505,411 | A * | 4/1996 | Heaton et al. | 248/70 |
| 5,729,125 | A * | 3/1998 | Schweitzer, Jr. | 324/127 |
| 5,921,510 | A | 7/1999 | Benoit et al. | |
| 5,942,964 | A * | 8/1999 | Takeuchi | 336/92 |
| 6,047,448 | A * | 4/2000 | Arnold | 24/16 PB |
| 6,072,125 | A | 6/2000 | Takeuchi | |
| 6,105,908 | A * | 8/2000 | Kraus | 248/74.3 |
| 7,986,202 | B2 * | 7/2011 | Woodson et al. | 335/6 |
| 2003/0222748 | A1 * | 12/2003 | Cern et al. | 336/178 |
| 2005/0017133 | A1 * | 1/2005 | Wochnick | 248/74.1 |
| 2007/0285201 | A1 * | 12/2007 | Zumoto et al. | 336/107 |
| 2009/0113675 | A1 * | 5/2009 | Saltenberger | 24/16 PB |
| 2009/0115226 | A1 * | 5/2009 | Shallcross et al. | 296/210 |
| 2009/0115403 | A1 * | 5/2009 | Bernklau | 324/127 |
| 2010/0066475 | A1 * | 3/2010 | Goldblatt | 336/92 |

FOREIGN PATENT DOCUMENTS

| | | | |
|---|---|---|---|
| DE | 202007017269 | U1 | 4/2008 |
| DE | 20 2007 017 296 | | 6/2011 |
| FR | 2 707 037 | | 12/1994 |
| JP | 557400 | | 4/1978 |
| JP | 57182981 | U | 11/1982 |
| JP | 313797 | | 2/1991 |
| JP | 10215096 | A | 8/1998 |
| JP | 2001307934 | A | 11/2001 |
| JP | 2006078316 | A | 3/2006 |
| WO | WO 98/22739 | | 5/1998 |

OTHER PUBLICATIONS

International Bureau, English Translation of the Written Opinion of the International Search Authority for International Application No. PCT/EP/2010/070088, Mar. 27, 2012, pp. 1-4, Geneva, Switzerland.
International Bureau, English Translation of International Preliminary Report on Patentability Chapter I for International Application No. PCT/EP/2010/070088, Jul. 4, 2012, M. 1-5, Geneva Switzerland.
English translation of Japanese Office Action dated Nov. 5, 2013 corresponding to Japanese Patent App. No. 2012-543792, 2 pp.
German Office Action dated Jul. 16, 2014 corresponding to German Patent App. No. 102009059006.4, 6 pp.
Chinese Office Action dated Sep. 1, 2014 corresponding to Chinese Patent Application No. 201080057762.5, 6 pages.

* cited by examiner

LOOPED FASTENING ELEMENT FOR REMOVABLY FIXING A CONDUCTOR TO A CURRENT TRANSFORMER HOUSING

CROSS-REFERENCE TO RELATED APPLICATIONS

This application is a U.S. national stage entry of International Application serial no. PCT/EP2010/070088 filed Dec. 17, 2010, which claims priority to German patent application no. 10 2009 059 006.4 filed Dec. 17, 2009. The contents of both of these prior applications are incorporated herein by reference in their entirety as if set forth verbatim.

FIELD

The innovation applies to a device for the detachable attachment of a conductor on a transformer housing with a fastening element, whereby the fastening element must be routed, so that the fastening element is placed onto the surface of the conductor at least partially when the conductor is attached to the transformer.

BACKGROUND

A conductor is usually routed through an opening that is provided on the transformer housing. The conductor is attached on the transformer housing with two screws or threaded pins, which are routed in two holding elements arranged on the transformer housing. For the purpose of fastening, the screws and/or threaded pins are turned inside of the holding element with a purely rotating movement in the direction of the conductor until their cross section is placed onto the surface of the conductor. Continued turning of the screws and/or threaded pins will result in securing the conductor in the transformer housing.

The disadvantage is hereby that the threaded pins and/or screws must travel a relatively long path for fastening on the conductor, whereby this occurs exclusively with a purely rotating movement, which requires a lot of force and time, especially with a larger number of transformer housings to be secured on a conductor.

Therefore, the innovation is based on the task to provide a device to fasten a conductor on a transformer housing, which is marked by a more simplified and faster installation.

SUMMARY

The solution for this task occurs according to the innovation with the characteristics of claim 1. Advantageous designs of the innovation are indicated in the subclaims.

The innovation-based device to fasten a conductor on a transformer housing has a fastening element, whereby the fastening element must be waged so that the fastening element is at least partially placed onto the surface of the conductor when the conductor is fastened on the transformer housing. The fastening element is characterized in that the fastening element is looped around the surrounding area of the conductor when it is secured.

The retaining element is preferably constructed in form of a flange, which is arranged on the transformer on the outer area of the transformer housing Two such retaining elements are thereby preferably arranged on two side areas of the transformer housing across from each other on the transformer housing so that not only the first retaining element but also the second retaining element can be used to feed through a fastening element according to the innovation. According to the innovation, the conductor is fastened in that the fastening element that is fed into the retaining element in the secured state is routed in a loop around the surrounding area of the conductor. The fastening element is thereby preferably constructed in form of an elongated rod, which is constructed with elasticity and can thereby be bent flexibly. The fastening element is preferably made of plastic. In the secured state, the conductor is placed onto the outer area of the fastening element, which is shaped as a loop and points toward the conductor and will be kept by it in its position. The conductor is thereby fed through the loop of the fastening element and held in this loop and fastened on the transformer housing. The fastening element is thereby preferably routed around the surrounding area of the conductor that is arranged perpendicular to the longitudinal axis of the conductor. Because the fastening element is looped around the conductor to secure the transformer housing on the conductor, the installation to secure the conductor is especially easy and quick. In addition, the fastening element can be flexibly adjusted to the dimension of the surrounding area of the conductor because of the loop shaped design of the fastening element in the fastened state, so that the conductor can be secured permanently and slip-proof with the fastening element regardless of the dimensions of the surrounding area of the conductor.

According to an advantageous design of the innovation, the fastening element has a first end section and a second end section across from the first end section, whereby the first end section can be fed through a first opening provided on the retaining element. The fastening element can thereby be secured in a fixed position on then retaining element. To secure the conductor, the fastening element is preferably routed from the end section of the fastening element that is kept in the opening with a second end section in a loop around the surrounding area of the conductor. After another preferred design of the innovation, the first section has an aperture through which the second end section can be routed. When the second end section is fed through the aperture on the first end section, the conductor will be fastened by routing the fastening in form of a loop. Because the second end section can be fed through an aperture that is provided on the first end section, whereby the second end section can thereby preferably be fed as far as needed through the aperture, the fastening element can be adjusted to the size of the surrounding area of the conductor flexibly so that the conductor can be permanently secured with the fastening element regardless of the size of the conductor. This makes an especially flexible fastening and/or mounting possible. For example, the fastening element may be constructed in form of a cable tie.

As an alternative, the second end section can be fed through a second opening provided on the retaining element according to a further preferred design of the innovation. The first opening and second opening must thereby preferably be shaped parallel to each other on the retaining element. The fastening element is preferably fed with its first end section through the first opening first, and then the fastening element is routed around the surrounding area of the conductor until the second end section can be fed through the second opening. This makes it possible to not only secure the first end section but also the second end section on the retaining element, which makes an especially easy handling of the device according to the innovation to fasten a conductor possible for the user.

It must further be preferably provided that latch mechanisms are designed at the first end section and/or second end section. The latch mechanisms, which may be constructed as snap tabs, can be used to secure the end sections of the fastening element within the openings, whereby the routing of the end sections through the openings can be adjusted optionally and very flexibly to the size of the surrounding area of the conductor depending on the number of latch mechanisms that are provided. The first opening and/or second opening thereby preferably have one hook element each, in which the latch mechanisms of the first end section and/or second end section can latch so that the end sections can be fastened in the desired position. If both end sections have latch mechanisms, both end sections can be evenly fed through the two openings provided in the retaining element so that an even load distribution is applied to the fastening element in the secured state.

In order to provide improved handling of the device according to the innovation, an operating element to release the first end section from the first opening and/or releasing the second end section from the second opening is provided in a further preferred design of the innovation on the retaining element. For example, the operating element can be used to operate a provided hook element in the first opening and/or second opening to secure the first end section and/or second end section within the first opening and/or second opening. For example, The operating element can be operated to release the hook element provided in the openings from the latch mechanisms provided at the end sections and/or the hook element can be unlatched from the latch mechanisms so that the first end section and/or second end section can be moved and/or slid freely within the first opening and/or second opening. The operating element is preferably provided in form of a push button that is arranged on the retaining element. The provision of such operating element can be implemented with an especially easy and quick installation of the fastening element.

The innovation will be explained in further detail below with reference to the attached drawings based on preferred designs.

DETAILED DESCRIPTION

Figure 1:
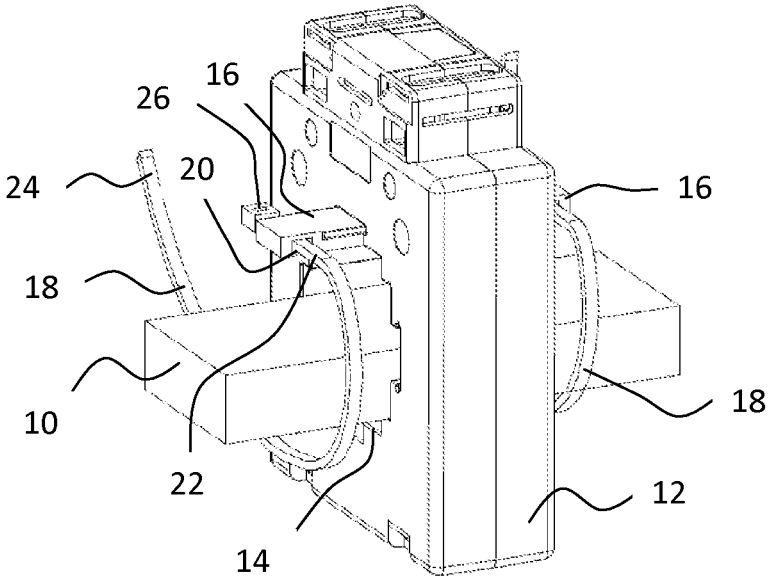
FIG. 1 shows a schematic illustration of a device according to the innovation according to an initial design.

FIG. 1 shows a device according to the innovation according to a first design, whereby a conductor 10 is hereby fed through an opening 14 provided on the transformer housing 12 and with two fastening elements 18 that are provided on the transformer housing 12, which are fastened and can be fed through retaining elements 16 arranged on one of two side areas of the transformer housing 12 across from each other. In the design shown in FIG. 1 the retaining elements 16 have a first opening 20 each, through which the fastening elements 18 are routed. A fastening element 18 thereby has a first end section 2422, which is fed through the opening 20 of the retaining element 16. To fasten the conductor 10 on the transformer housing the first end section 24 of the fastening element 18, which is positioned across from the second end section 22, is fed through an aperture 26 that is provided on fastening element 18. FIG. 1 shows the device according to the innovation in a state where the conductor 10 has not yet been secured with the fastening element 18 because the first end section 24 of the fastening element 18 has not yet been fed through the aperture 26 of the second end section 22. The fastening element 18 is hereby preferably designed in form of a cable tie. In the secured state, which is not shown here, the fastening element 18 is routed around the surrounding area of the conductor 10 in a loop.

Figure 2:
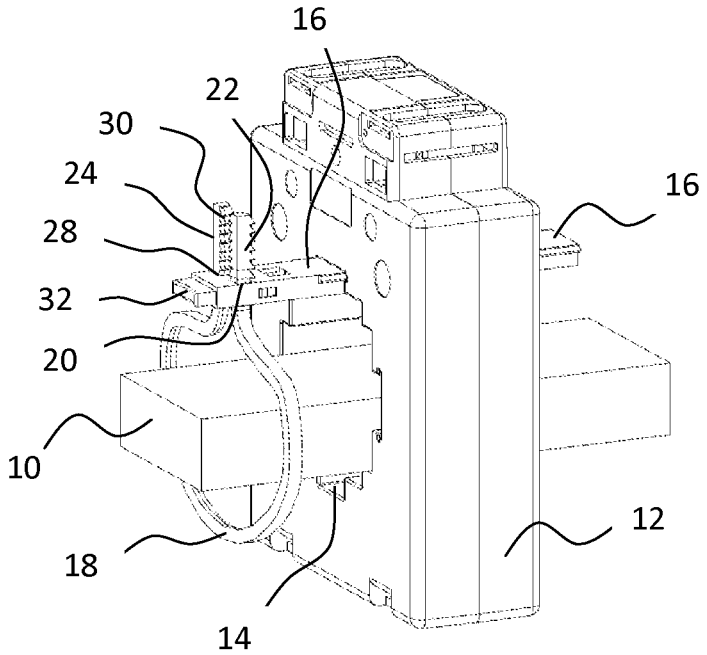
FIG. 2 shows a schematic illustration of a device according to the innovation according to a second design.
Figure 3:
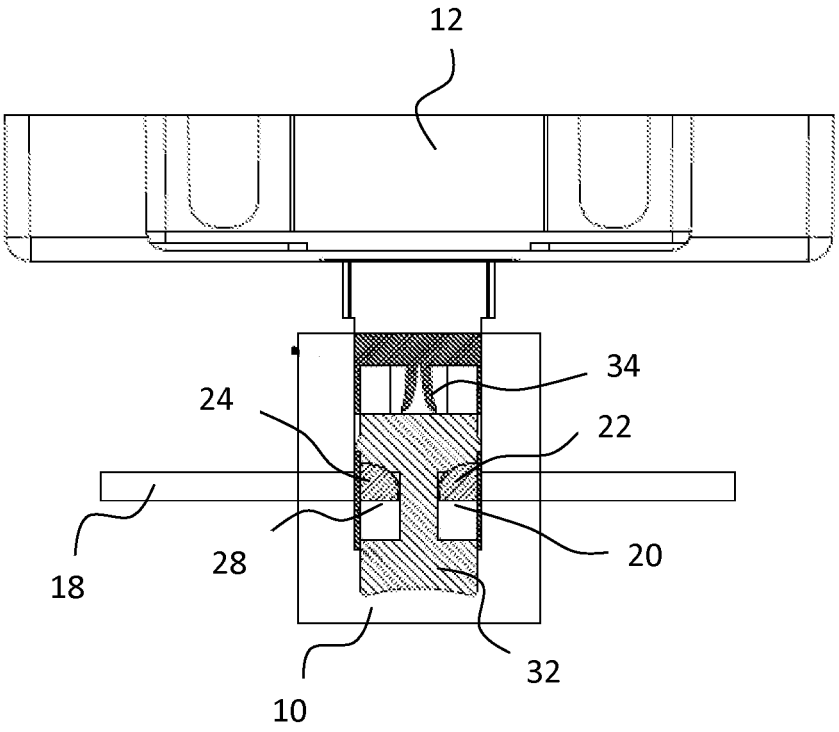
FIG. 3 shows a schematic top view of the device according to the innovation shown in FIG. 2 whereby the retaining element is shown in across-section.

FIGS. 2 and 3 show a device according to the innovation according to a second design, where a conductor 10 is fed through an opening 14 that is provided on the transformer housing 12.

A fastening element 18 is provided on both sides of the transformer housing 12 to attach the conductor 10, which is fed in a loop around the surrounding area of the conductor 10 in the secured state, as this is shown in FIG. 2. The fastening element 18 is designed in form of an elongated rod made of flexible material. The fastening element 18 has an initial end section 24 and a second end section 22 whereby the second end section 22 is fed through a first opening 20 on the retaining element 16 and the first end section 24 is fed through a second opening 28 on the retaining element 16. Multiple latch mechanisms are designed on the first end section 24 and the second end section 22 in form of snap tabs, which can be fed through the openings 20, 28 and that can be latched inside of the openings 20, 28 in hook elements, which are not shown here, which can lock into the snap tabs 30. An operating element 32, in form of a push button, for example, is provided on raining element 16 to release the fastening element 18. Operating the operating element 32 will detach the hook elements from the latch mechanisms so that the latch mechanisms 30 will be released and the first end section 22 and second end section 24 of the fastening element 18 can be moved freely in the first opening 20 and the second opening 28.

FIG. 3 shows a more detailed illustration of the device according to the innovation according to the second design in form of a top view onto the transformer housing 12 and conductor 10, whereby the retaining element 16 is shown in a cross-section. It is hereby recognizable that the operating element 32 can grip into spring arms 34 provided within the retaining element 16.

FIG. 3 shows the fastening element 18 in a position where the fastening element 18 is permanently fixed within the openings 20, 28 and kept in its position with the operating element 32. Operating the operating element 32 in the direction of the transformer housing 12, the fastening element 32 will latch in the spring arms 34 and will be kept by them in this position; whereby the fastening element 18 is thereby released by the operating element 32 and will thereby be freely movable in the openings 20, 28. As soon as the user releases the operating element 32 again, it will move back into the position shown in FIG. 3 due to the spring arms 34, so that the end sections 22, 24 of fastening element 18 are secured again and can no longer be moved in the openings 20, 28. This makes a flexible adjustment of the fastening element 18 to the size of the surrounding area of the conductor 10 to be secured possible so that the conductor 10 can be kept in place with a tensioned state of the fastening 18 that is routed around the surrounding surface.

REFERENCE CODE LIST

Conductor 10
Transformer housing 12
Opening 14
Retaining element 16
Fastening element 18
First opening 20

First end section 22
Second end section 24
Aperture 26
Second opening 28
Latch mechanism 30
Operating element 32
Spring arm 34

What is claimed is:

1. A device comprising:

a transformer housing configured so that a conductor is detachably fastenable on the transformer housing, wherein the transformer housing comprises a retaining element, wherein the retaining element is arranged on the transformer housing and has at least one opening passing therethrough; and a fastening element that is positioned in a secured state on the transformer housing at least partially in contact with the surface of the conductor, wherein the fastening element loops around an area of the conductor when in the secured state, wherein the fastening element has a first end section and a second end section located opposite the first end section, wherein the first end section is fed through the at least one opening of the retaining element, and wherein the fastening element is secured in a fixed position on the retaining element by the first end section passing through the at least one opening in the retaining element.

2. The device of claim 1, further comprising latch mechanisms disposed at the first end section and/or second end section of the retaining element.

3. The device of claim 2, wherein the retaining element further comprises an operating element configured to release the first end section and/or the second end section from the first and/or second opening of the retaining element.

* * * * *